US011467517B2

(12) United States Patent
Choi et al.

(10) Patent No.: US 11,467,517 B2
(45) Date of Patent: Oct. 11, 2022

(54) TONER REFILL CARTRIDGE WITH AUTOMATIC REFILLING STRUCTURE

(71) Applicant: HEWLETT-PACKARD DEVELOPMENT COMPANY, L.P., Spring, TX (US)

(72) Inventors: Woongyong Choi, Gyeonggi-do (KR); Yunkyu Shim, Gyeonggi-do (KR); Seunggweon Lee, Gyeonggi-do (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/309,516

(22) PCT Filed: Mar. 4, 2020

(86) PCT No.: PCT/US2020/020897
§ 371 (c)(1),
(2) Date: Jun. 3, 2021

(87) PCT Pub. No.: WO2021/061188
PCT Pub. Date: Apr. 1, 2021

(65) Prior Publication Data

US 2022/0057729 A1 Feb. 24, 2022

(30) Foreign Application Priority Data

Sep. 24, 2019 (KR) ..... 10-2019-0117544

(51) Int. Cl.
*G03G 15/08* (2006.01)
*G03G 21/16* (2006.01)

(52) U.S. Cl.
CPC ..... *G03G 15/0886* (2013.01); *G03G 15/0872* (2013.01); *G03G 15/0889* (2013.01); *G03G 21/1647* (2013.01)

(58) Field of Classification Search
CPC ..... G03G 15/0872; G03G 15/0886; G03G 15/0889; G03G 15/757; G03G 21/1647; G03G 21/1857; G03G 2221/1657
See application file for complete search history.

(56) References Cited

U.S. PATENT DOCUMENTS

| | | | |
|---|---|---|---|
| 5,383,502 | A | 1/1995 | Fisk |
| 5,797,073 | A | 8/1998 | Russell |
| 6,212,338 | B1 | 4/2001 | Hagihara et al. |
| 6,269,234 | B1 | 7/2001 | Kurz et al. |

(Continued)

FOREIGN PATENT DOCUMENTS

| | | |
|---|---|---|
| JP | 07-168435 A | 7/1995 |
| JP | H07199620 | 8/1995 |

(Continued)

*Primary Examiner* — Hoang X Ngo
(74) *Attorney, Agent, or Firm* — Trop Pruner & Hu, P.C.

(57) ABSTRACT

An example toner refill cartridge includes a body to accommodate toner and having a toner discharge hole, a shutter being rotatable between a first position at which the toner discharge hole is closed and a second position at which the toner discharge hole is opened, a coupler to rotate by receiving an external rotational force, an agitation member to rotate and agitate the toner by receiving a rotational force from the coupler, and a connection member to selectively transmit a rotational force of the coupler to the shutter.

15 Claims, 16 Drawing Sheets

(56) References Cited

U.S. PATENT DOCUMENTS

| | | | | |
|---|---|---|---|---|
| 6,332,065 | B1 | 12/2001 | Howard | |
| 8,532,541 | B2 * | 9/2013 | Yahagi | G03G 15/0886 399/258 |
| 9,031,425 | B2 | 5/2015 | Mendoza | |
| 9,958,807 | B1 | 5/2018 | Huang | |

FOREIGN PATENT DOCUMENTS

| | | | |
|---|---|---|---|
| JP | 08-152775 | A | 6/1996 |
| JP | 2006221079 | | 8/2006 |
| KR | 1020140080781 | | 7/2014 |

* cited by examiner

TONER REFILL CARTRIDGE WITH AUTOMATIC REFILLING STRUCTURE

BACKGROUND

In an image forming apparatus using an electrophotographic method, toner is supplied to an electrostatic latent image formed on a photoconductor to form a visible toner image on the photoconductor, the toner image is transferred to a print medium directly or via an intermediate transfer medium, and the transferred toner image is fused and fixed to the print medium.

A developing cartridge accommodates toner and supplies the toner to the electrostatic latent image formed on the photoconductor to form the visible toner image. When the toner accommodated in the developing cartridge is used up, the developing cartridge may be detached from a main body of the image forming apparatus, and a new developing cartridge may be installed in the main body. Also, the developing cartridge may be filled with new toner by using a toner refill kit such as a toner refill cartridge.

BRIEF DESCRIPTION OF DRAWINGS

Various examples will be described below by referring to the following figures.

DETAILED DESCRIPTION OF EXAMPLES

Figure 1:
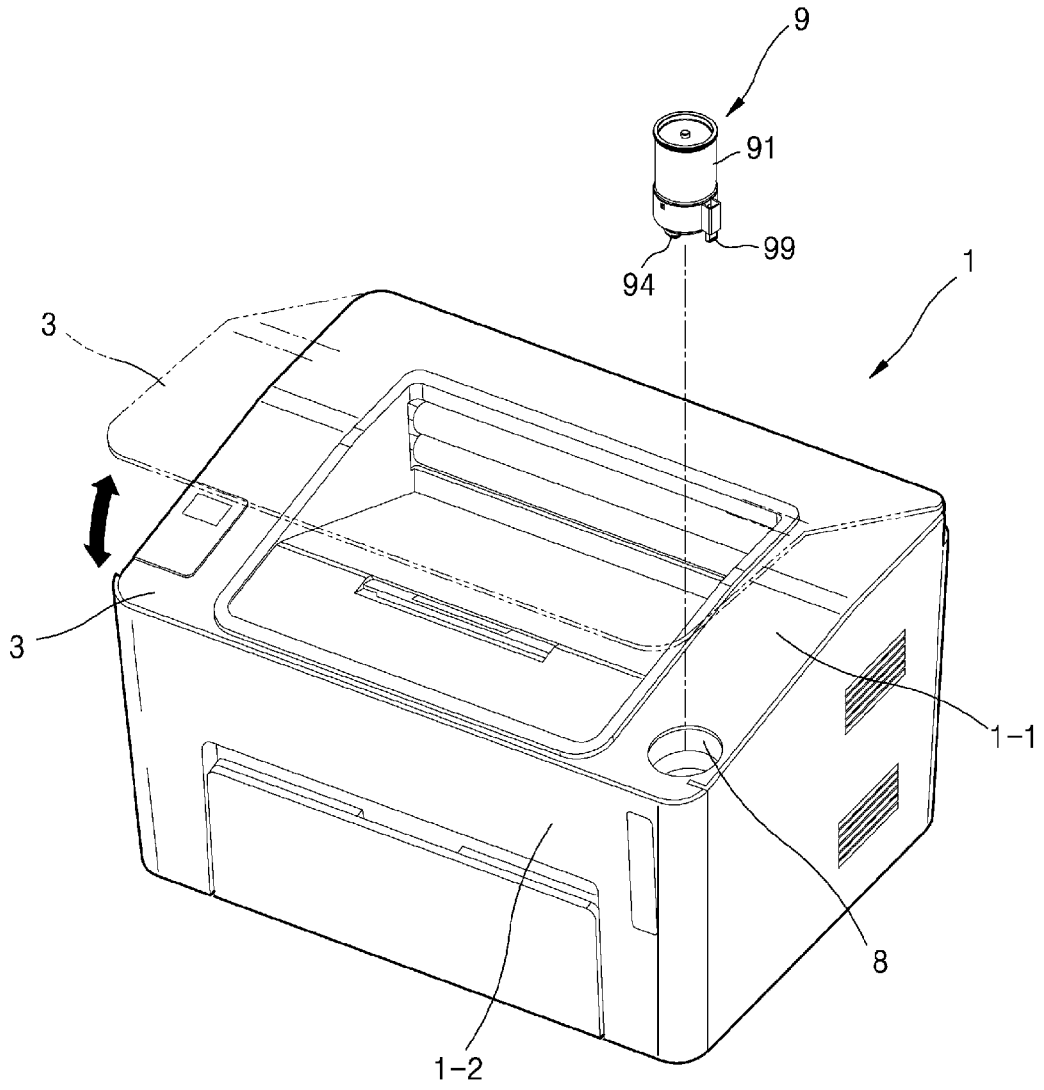
FIG. 1 is a schematic perspective view of an electrophotographic image forming apparatus according to an example.

Hereinafter, various examples will be described with reference to the drawings. Like reference numerals in the specification and the drawings denote like elements, and thus a redundant description may be omitted.

Figure 2:
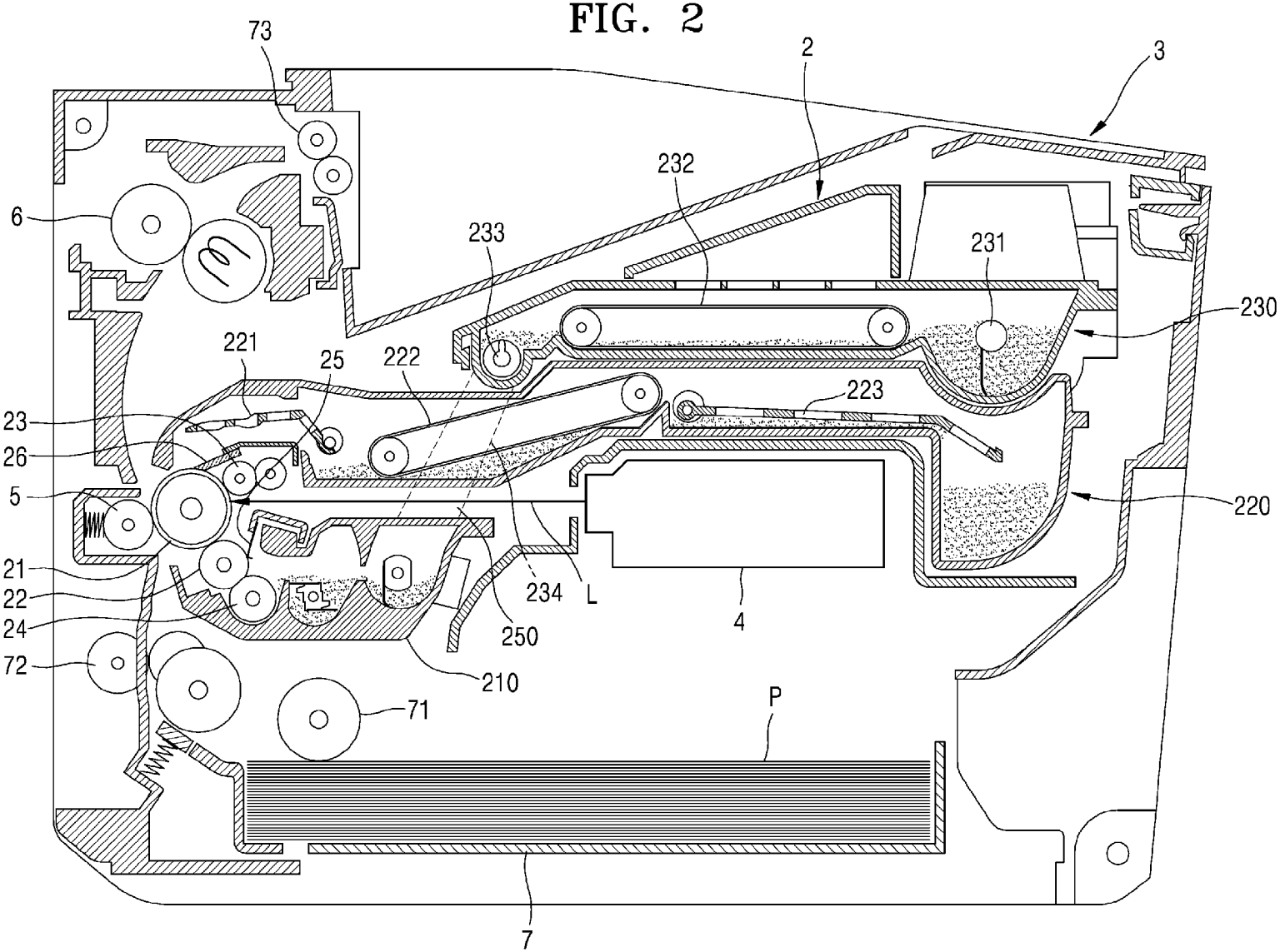
FIG. 2 is a schematic cross-sectional view of the electrophotographic image forming apparatus of FIG. 1 according to an example.
Figure 3:
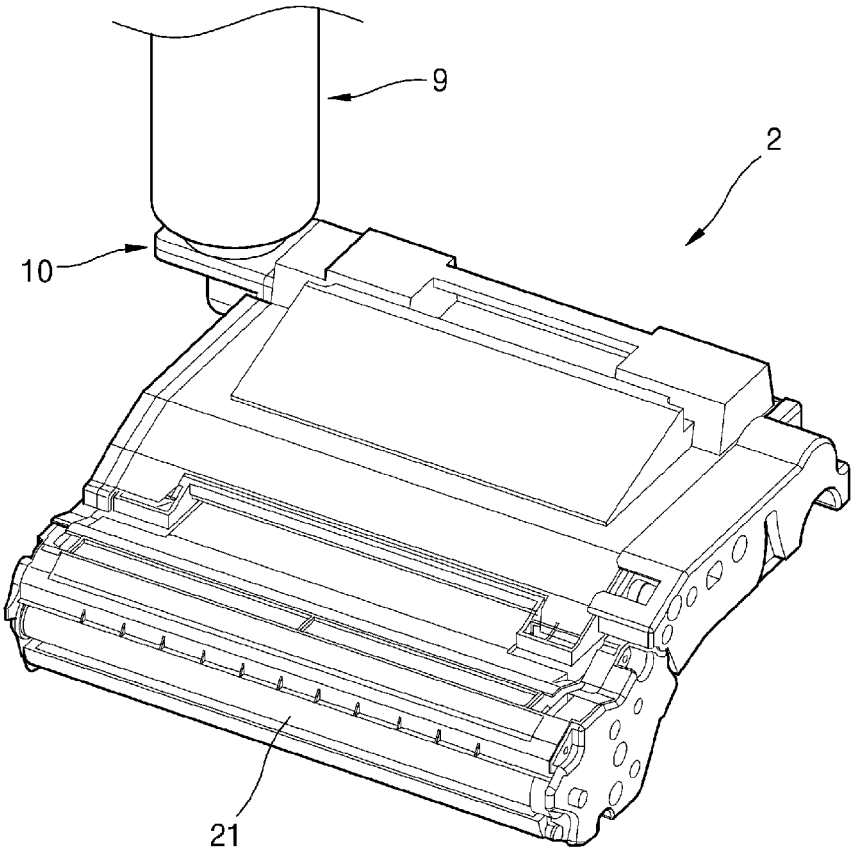
FIG. 3 is a perspective view of a developing cartridge according to an example.

FIG. 1 is a schematic perspective view of an electrophotographic image forming apparatus according to an example. FIG. 2 is a schematic cross-sectional view of the electrophotographic image forming apparatus of FIG. 1 according to an example. FIG. 3 is a perspective view of a developing cartridge according to an example.

Referring to FIGS. 1, 2, and 3, an image forming apparatus may include a main body 1 and a developing cartridge 2 that is capable of being attached to and detached from the main body 1. The main body 1 may be provided with a door 3. Although FIG. 1 illustrates that the door 3 opens an upper portion of the main body 1, a door that opens a side portion or a front portion of the main body 1 may be employed, as necessary. The developing cartridge 2 may be installed in or removed from the main body 1 by opening the door 3.

A photoconductive drum 21, as an example of a photoconductor on which an electrostatic latent image may be formed, may include a cylindrical metal pipe and a photoconductive layer formed on an outer circumference thereof and having photoconductivity. A charging roller 23 is an example of a charger that charges a surface of the photoconductive drum 21 to a uniform electric potential. A charge bias voltage is applied to the charging roller 23. A corona charger (not shown) may be used instead of the charging roller 23.

An optical scanner 4 scans light modulated according to image information onto a surface of the photoconductive drum 21 charged to the uniform electric potential. As the optical scanner 4, for example, a laser scanning unit (LSU) for scanning light emitted from a laser diode toward the photoconductive drum 21 by deflecting the light in a main scanning direction using a polygon mirror may be employed.

A developing roller 22 supplies toner to an electrostatic latent image formed on the surface of the photoconductive drum 21 so as to develop the electrostatic latent image. In an example, toner is used as a developing agent, and a one-component contact developing method is employed in which the developing roller 22 and the photoconductive drum 21 contact each other to form a developing nip. When the developing bias voltage is applied to the developing roller 22, toner is moved through the developing nip so as to adhere to the electrostatic latent image formed on the surface of the photoconductive drum 21. A supply roller 24 supplies toner to adhere to the developing roller 22. A supply bias voltage may be applied to the supply roller 24 to adhere the toner to the developing roller 22. A regulator 25 regulates the amount of toner to adhere on the surface of the developing roller 22. A cleaning member 26 removes, before charging, residual toner and foreign materials from the surface of the photoconductive drum 21.

A transfer roller 5 is an example of a transfer device, and is located to face the photoconductive drum 21 to form a transfer nip. A transfer bias voltage for transferring a toner image formed on the surface of the photoconductive drum 21 to a print medium P is applied to the transfer roller 5. The print medium P may be drawn by a pickup roller 71 from a loading tray 7 and fed by a feed roller 72 to the transfer nip where the transfer roller 5 and the photoconductive drum 21 face each other. The toner image transferred by the transfer roller 5 to a surface of the print medium P is maintained on the surface of the print medium P due to electrostatic attraction. A fuser 6 applies heat and pressure to the toner image to be fused and fixed to the print medium P, thereby forming a permanent print image on the print medium P. The print medium P having the permanent print image is discharged to the outside of the main body 1 by a discharge roller 73.

As illustrated in FIGS. 2 and 3, the developing cartridge 2 may include a developing portion 210 where the photoconductive drum 21 and the developing roller 22 are installed, a waste toner accommodating portion 220 where waste toner removed from the photoconductive drum 21 is accommodated, and a toner accommodation portion 230 connected to the developing portion 210 to accommodate toner. A toner filling portion 10 provides an interface between the developing cartridge 2 and a toner refill cartridge 9 that is described later, to refill toner in the toner accommodation portion 230.

The waste toner accommodating portion 220 is located above the developing portion 210, and an optical path 250 is formed between the waste toner accommodating portion 220 and the developing portion 210. The waste toner removed by the cleaning member 26 from the photoconductive drum 21 is accommodated in the waste toner accommodating portion 220. The waste toner is transferred to the inside of the waste toner accommodating portion 220 by one or more waste toner transfer members 221, 222, and 223.

The toner accommodation portion 230 is connected to the toner filling portion 10 and accommodates toner. The toner accommodation portion 230, as illustrated in FIG. 2 by a dashed line, is connected to the developing portion 210 by a toner supply portion 234. The toner supply portion 234 is located outside an effective width of light L so as not to interfere with the light L scanned by the optical scanner 4 in the main scanning direction. One or more toner supply members 231, 232, and 233 for supplying toner to the developing portion 210 via the toner supply portion 234 may be installed in the toner accommodation portion 230. The toner supply member 233 may transfer toner to the toner supply portion 234 by carrying the toner in the main scanning direction.

The developing cartridge 2 forms a visible toner image by supplying toner accommodated in the toner accommodation portion 230 to the electrostatic latent image formed on the photoconductive drum 21, and may be attached to and detached from the main body 1. In an example, the developing cartridge 2 may be refilled with toner while the developing cartridge 2 is mounted in the main body 1, that is, without detaching the developing cartridge 2 from the main body 1.

As illustrated in FIG. 1, the toner refill cartridge 9 may include a body 91 to accommodate toner therein, a coupler 94, a toner discharge hole (not shown), and a communication portion 99 for communication between the toner refill cartridge 9 and the image forming apparatus. When the toner refill cartridge 9 is mounted on the toner filling portion 10, the communication portion 99 is electrically connected to the image forming apparatus. The communication portion 99 may perform functions such as checking whether the toner refill cartridge 9 is mounted in the toner filling portion 10, transmitting information of the toner refill cartridge 9 to the main body 1, etc. The communication portion 99 may include a so-called customer replaceable unit monitor (CRUM).

A communicating portion 8 is provided in the main body 1 to enable access to the toner filling portion 10 from the outside of the main body 1 while the developing cartridge 2 is mounted in the main body 1. For example, the communicating portion 8 may be provided at a position on an upper surface 1-1 of the main body 1 close to a front surface portion 1-2. The toner filling portion 10 is located under the communicating portion 8. The toner refill cartridge 9 may be inserted into the communicating portion 8 from above the main body 1, and thus, as illustrated in FIG. 3, the toner refill cartridge 9 may be connected to the toner filling portion 10. In this state, toner accommodated in the body 91 may be discharged through the toner discharge hole and may be supplied to the toner accommodation portion 230 of the developing cartridge 2 via the toner filling portion 10. The toner refill cartridge 9 may be removed from the communicating portion 8 after toner refill.

Figure 4:
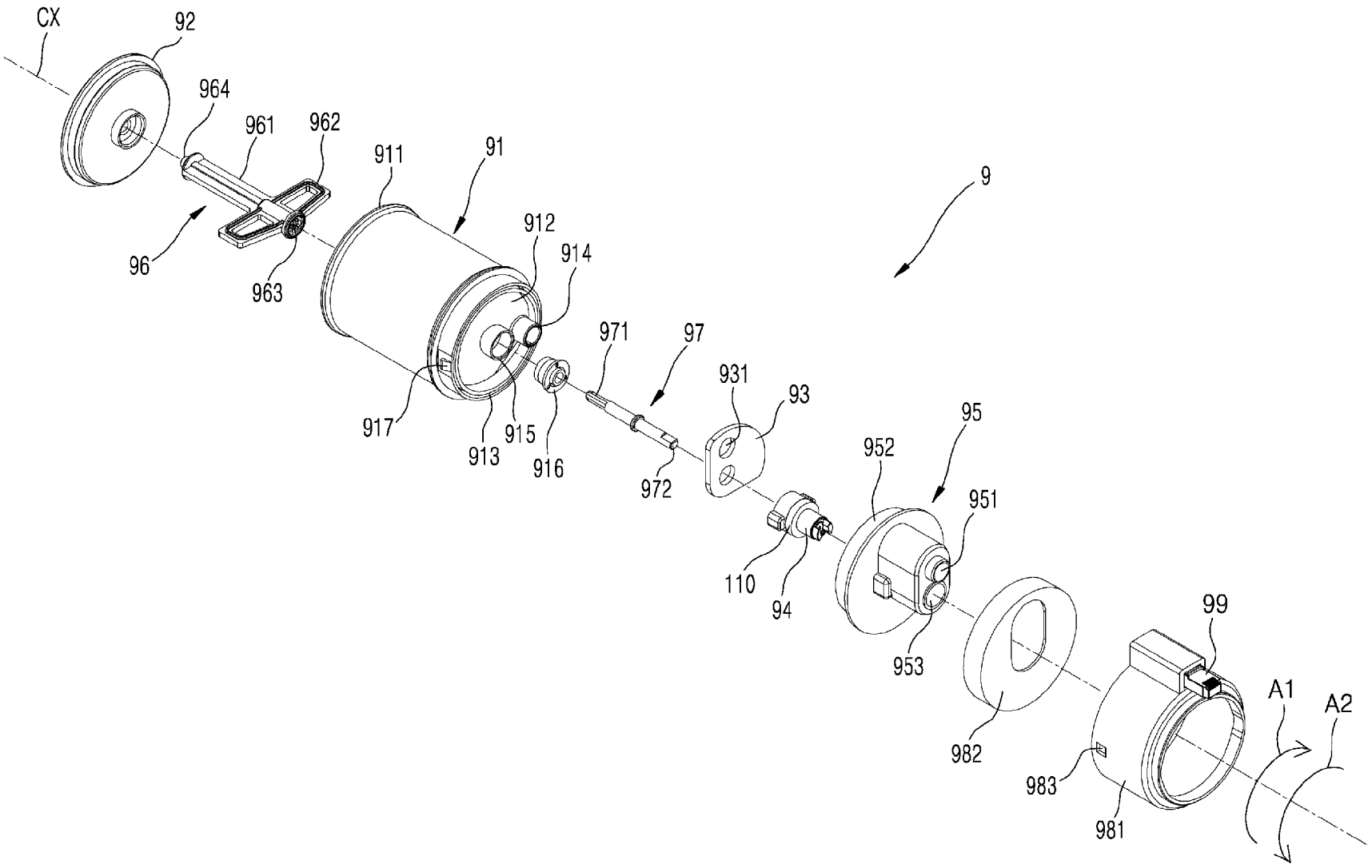
FIG. 4 is an exploded perspective view of a toner refill cartridge according to an example.

FIG. 4 is an exploded perspective view of a toner refill cartridge according to an example.

Referring to FIG. 4, the toner refill cartridge 9 may include the body 91, a shutter 95, the coupler 94, and a connection member. Toner may be accommodated in the body 91. A lid 92 is coupled to one end portion 911 of the body 91. A toner discharge hole 914 through which toner may be discharged is provided at another end portion 912 of the body 91 (i.e., the end portion of the body 91 opposite to the end portion 911 at which the lid 92 is located). The toner discharge hole 914 may have, for example, a cylindrical shape protruding from the other end portion 912 of the body 91.

The shutter 95 opens and closes (e.g., exposes and covers) the toner discharge hole 914. The shutter 95 is rotatably coupled to the other end portion 912 of the body 91. In an example, the shutter 95 may be rotated around a center axis CX of the body 91. The body 91 may be provided with a first support portion 913 protruding from the other end portion 912 in a cylindrical shape. The shutter 95 may be provided with a second support portion 952 having a cylindrical shape and rotatably supported inside the first support portion 913.

The shutter 95 may pivot between a first position at which the toner discharge hole 914 is closed (e.g., covered) and a second position at which the toner discharge hole 914 is opened (e.g., exposed). The toner discharge hole 914 may be located to be displaced in a radial direction from the center axis CX. The shutter 95 may be provided with an opening portion 951 that is displaced in the radial direction from the center axis CX. The displacement amounts of the toner discharge hole 914 and the opening portion 951 from the center axis CX may be the same. As the shutter 95 rotates with respect to the center axis CX, the toner discharge hole 914 and the opening portion 951 may be misaligned or aligned with each other according to the rotation phase. At the first position, the opening portion 951 is located to be misaligned with the toner discharge hole 914, and the toner discharge hole 914 is closed. At the second position, the opening portion 951 is aligned with the toner discharge hole 914, and the toner discharge hole 914 is opened. When the toner discharge hole 914 is opened, toner may be discharged by passing through the toner discharge hole 914 and the opening portion 951.

A sealing member 93 for preventing toner leakage may be provided between the shutter 95 and the toner discharge hole 914. The sealing member 93 may rotate with the shutter 95. The sealing member 93 may be, for example, a sponge. An opening 931 of the sealing member 93 is aligned with the opening portion 951 of the shutter 95. When the shutter 95 is located at the first position, the sealing member 93 shuts (i.e., covers) the toner discharge hole 914, and when the shutter 95 is located at the second position, the opening 931 of the sealing member 93 and the opening portion 951 of the shutter 95 are aligned with the toner discharge hole 914 so that the toner discharge hole 914 is open (e.g., exposed).

The coupler 94 may be exposed to the outside of the toner refill cartridge 9 through a power connection opening 953 provided in the shutter 95. The coupler 94 may be rotated by receiving a rotational force from an external source. For example, when the toner refill cartridge 9 is mounted in the toner filling portion 10 through the communicating portion 8, a drive coupler (not shown) provided in the toner filling portion 10 may be connected to the coupler 94 through the power connection opening 953. The coupler 94 may be rotated by receiving a rotational force from the drive coupler.

When the toner refill cartridge 9 is left unused, toner inside the body 91 may be hardened (e.g., packed). In this state, as fluidity of the toner is very low, even when the toner discharge hole 914 is opened, the toner may not be discharged well through the toner discharge hole 914. In an example, the toner refill cartridge 9 may include an agitation member 96. The agitation member 96 is rotatably installed inside the body 91 to agitate the toner. The agitation member 96 may include an agitation shaft 961 and an agitation blade 962 extending from the agitation shaft 961 in the radial direction. As the agitation member 96 rotates, the agitation blade 962 agitates the toner inside the body 91 so that a gap between toner powders increases and thus the fluidity of toner increases. Accordingly, when the toner discharge hole 914 is opened, the toner may be more easily discharged through the toner discharge hole 914.

The agitation member 96 is rotated inside the body 91 by receiving a rotational force from the coupler 94, so as to agitate the toner. The shutter 95 is rotated by receiving a rotational force from the coupler 94. In an example, the coupler 94, the shutter 95, and the agitation member 96 rotate around the same rotation axis. For example, the coupler 94, the shutter 95, and the agitation member 96 rotate around the center axis CX of the body 91.

The agitation member 96 is connected to the coupler 94 and rotated. In an example, a cylindrical portion 915 extending in a cylindrical shape along the center axis CX is provided at the other end portion 912 of the body 91. A drive shaft 97 passes through the cylindrical portion 915 and extends to the inside of the body 91. One end portion 971 of the drive shaft 97 is coupled to one end portion 963 of the agitation shaft 961. Another end portion 964 of the agitation shaft 961 is supported by the lid 92. A shaft support member 916 supporting the drive shaft 97 is provided in the cylindrical portion 915. Another end portion 972 of the drive shaft 97 is coupled to the coupler 94. According to the above configuration, the coupler 94 is rotatably supported by the body 91, and exposed to the outside of the toner refill cartridge 9 through the power connection opening 953. When the coupler 94 rotates, the agitation member 96 may be rotated in the same direction as the rotation direction of the coupler 94.

A cover 981 may be coupled to the body 91. For example, the cover 981 may be coupled to the outer circumference of the first support portion 913 of the body 91. A catching step 917 may be provided on the first support portion 913, and a catching recess 983 to be caught by the catching step 917 may be provided in the cover 981. The communication portion 99 that is described above is provided in the cover 981. An escape prevention member 982 for preventing the shutter 95 from escaping from the inner circumference of the first support portion 913 in a direction along the center axis CX may be provided between the cover 981 and the shutter 95. The escape prevention member 982 may be rotated with the shutter 95.

The connection member selectively transmits the rotational force of the coupler 94 to the shutter 95. In an example, the connection member transmits a rotational force of the coupler 94 in a first direction A1 to the shutter 95, but does not transmit, to the shutter 95, a rotational force of the coupler 94 in a second direction A2 that is opposite to the first direction A1. In other words, the connection member may have a one-way clutch structure of transmitting only the rotational force of the coupler 94 in the first direction A1 to the shutter 95. The shutter 95 is rotated in the first direction A1 to be moved (e.g., sequentially switched) between the first position and the second position.

The one-way clutch structure may include a variety of types. An example of a connection member having a one-way clutch structure is described below.

Figure 5:
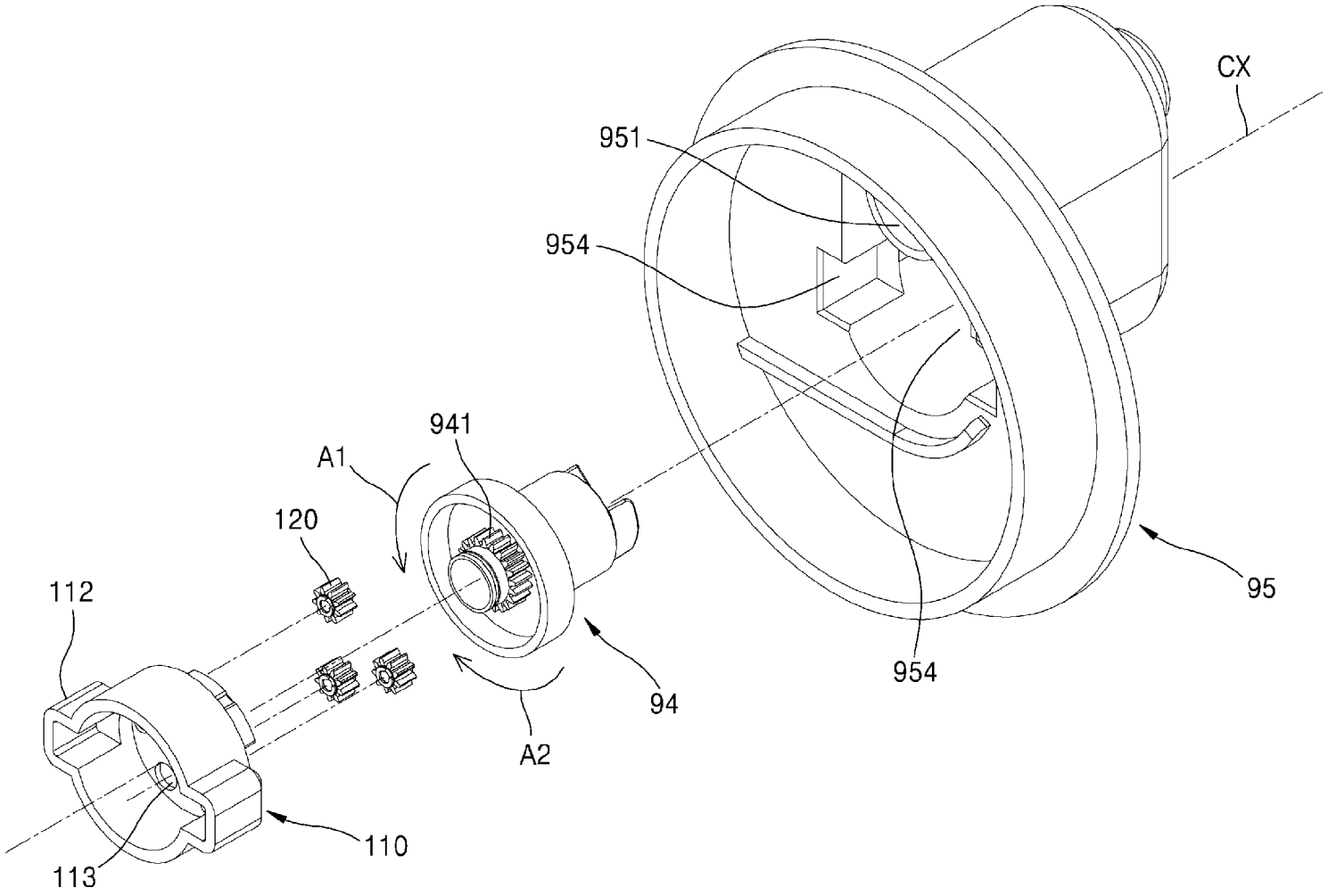
FIG. 5 is an exploded perspective view of a connection member according to an example.
Figure 6:
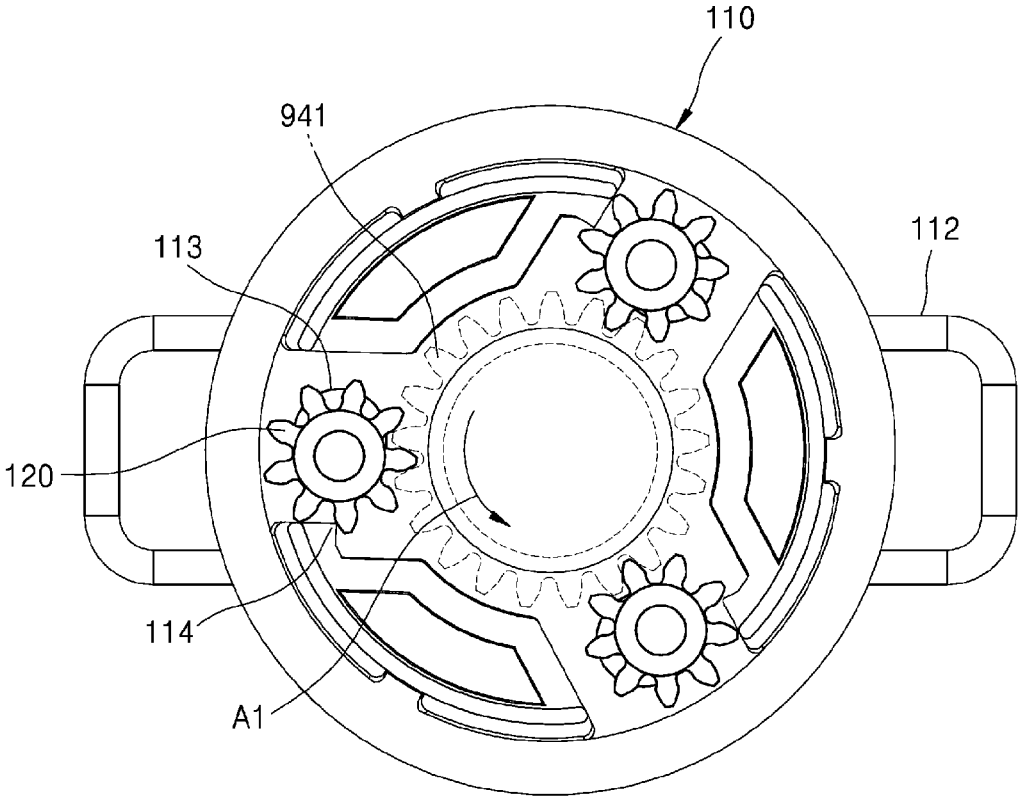
FIG. 6 illustrates an operation of the connection member of FIG. 5, showing a state in which a coupler rotates in a first direction according to an example.
Figure 7:
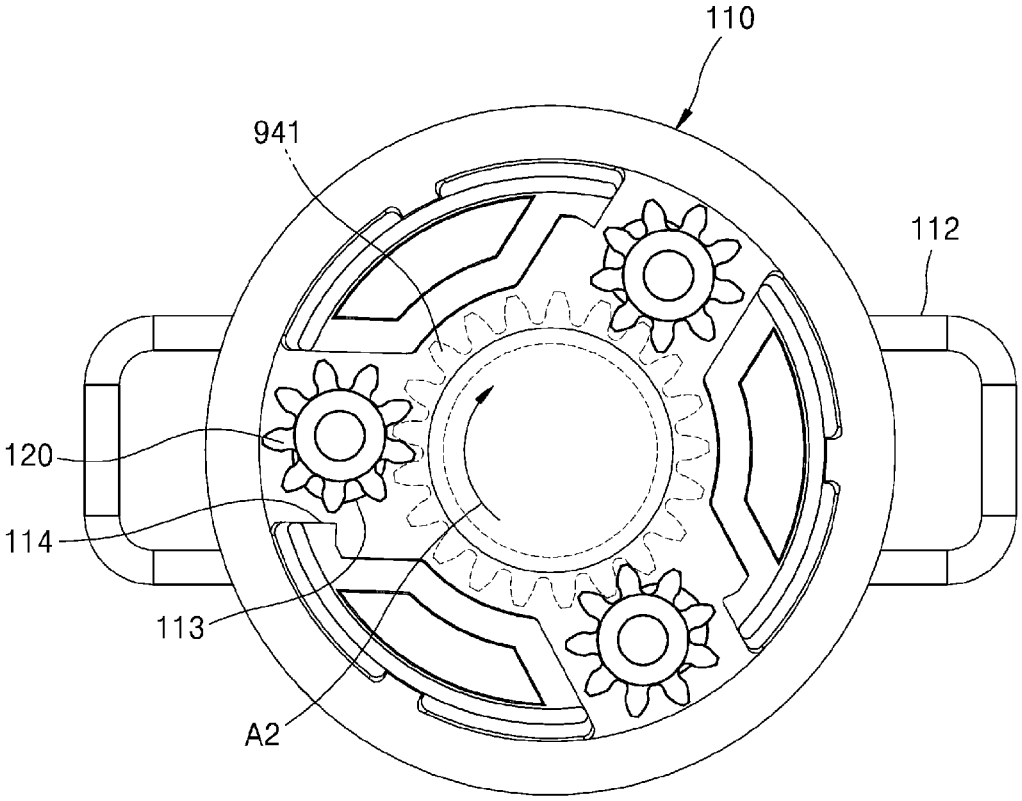
FIG. 7 illustrates an operation of the connection member of FIG. 5, showing a state in which the coupler rotates in a second direction according to an example.

FIG. 5 is an exploded perspective view of a connection member according to an example. FIGS. 6 and 7 illustrate an operation of the connection member of FIG. 5, respectively showing a state in which a coupler rotates in a first direction and a second direction according to various examples.

Referring to FIGS. 5, 6, and 7, a connection member may include a link member 110, a sun gear 941, and a planet gear 120.

The link member 110 is connected to the shutter 95 to rotate the shutter 95. For example, a protruding portion 112 may be provided in the link member 110, and a concave portion 954 having a complementary shape to the protruding portion 112 may be provided in the shutter 95. The protruding portion 112 is inserted into the concave portion 954. According to the above configuration, when the link member 110 rotates, the shutter 95 may be rotated.

The link member 110 is provided with a guide portion 113 having a slot shape and a latch portion 114. The guide portion 113 may have, for example, a slot shape cut in a circumferential direction with respect to the center axis CX. The latch portion 114 is formed such that the planet gear 120 is caught by the latch portion 114 when the coupler 94 rotates in the first direction A1. The latch portion 114 may be located to a side in the first direction A1 with respect to the guide portion 113. The sun gear 941 is provided in the coupler 94. The planet gear 120 is installed in the guide portion 113 to be rotated by being engaged with the sun gear 941. In the illustrated example, three planet gears 120 are engaged with the sun gear 941 and three latch portions 114 are provided. In that case, each planet gear 120 is engaged with a latch portion 114 so that the link member 110 is rotated with the coupler 94 when the coupler 94 rotates in the first direction A1, and is separated from the latch portion 114 so that the link member 110 is not rotated when the coupler 94 rotates in the second direction A2.

As illustrated in FIG. 6, when the coupler 94 rotates in the first direction A1, the sun gear 941 is also rotated with the coupler 94 in the first direction A1. The planet gear 120 engaged with the sun gear 941 is rotated in a direction opposite to the rotation direction of the sun gear 941. As the guide portion 113 has a slot shape, the planet gear 120 moves along the guide portion 113 in the first direction A1 that is the rotation direction of the sun gear 941, so as to be engaged with the latch portion 114. When being caught by (i.e., engaged with) the latch portion 114, the planet gear 120 is unable to be further rotated, and the rotational force of the coupler 94 is transmitted to the link member 110 via the sun gear 941, the planet gear 120, and the latch portion 114, so that the link member 110 is rotated with the coupler 94 in the first direction A1. As the protruding portion 112 of the link member 110 is inserted into the concave portion 954 of the shutter 95, the shutter 95 is rotated in the first direction A1.

As illustrated in FIG. 7, when the coupler 94 is rotated in the second direction A2, the sun gear 941 is rotated with the coupler 94 in the second direction A2. As the guide portion 113 has a slot shape, the planet gear 120 moves along the guide portion 113 in the second direction A2 that is the rotation direction of the sun gear 941, so as to be separated from the latch portion 114. The planet gear 120 is engaged with the sun gear 941 within the guide portion 113 and rotated in a direction opposite to the rotation direction of the sun gear 941. When the coupler 94 rotates in the second direction A2, the rotational force of the coupler 94 is not transmitted to the link member 110. Accordingly, the link member 110 is not rotated, and the shutter 95 is not rotated either. The shutter 95 is maintained at the second position at which the toner discharge hole 914 is opened.

Figure 8:
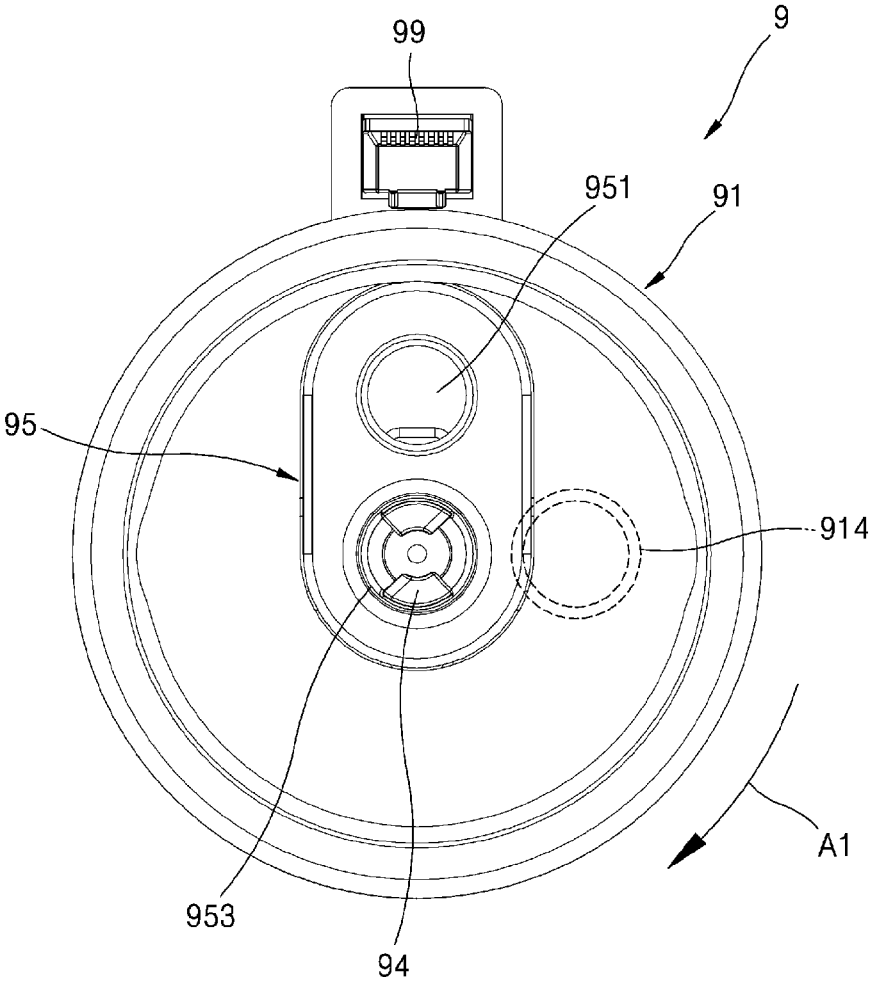
FIG. 8 illustrates a state in which a shutter is located at a first position of the toner refill cartridge of FIG. 4 according to an example.
Figure 9:
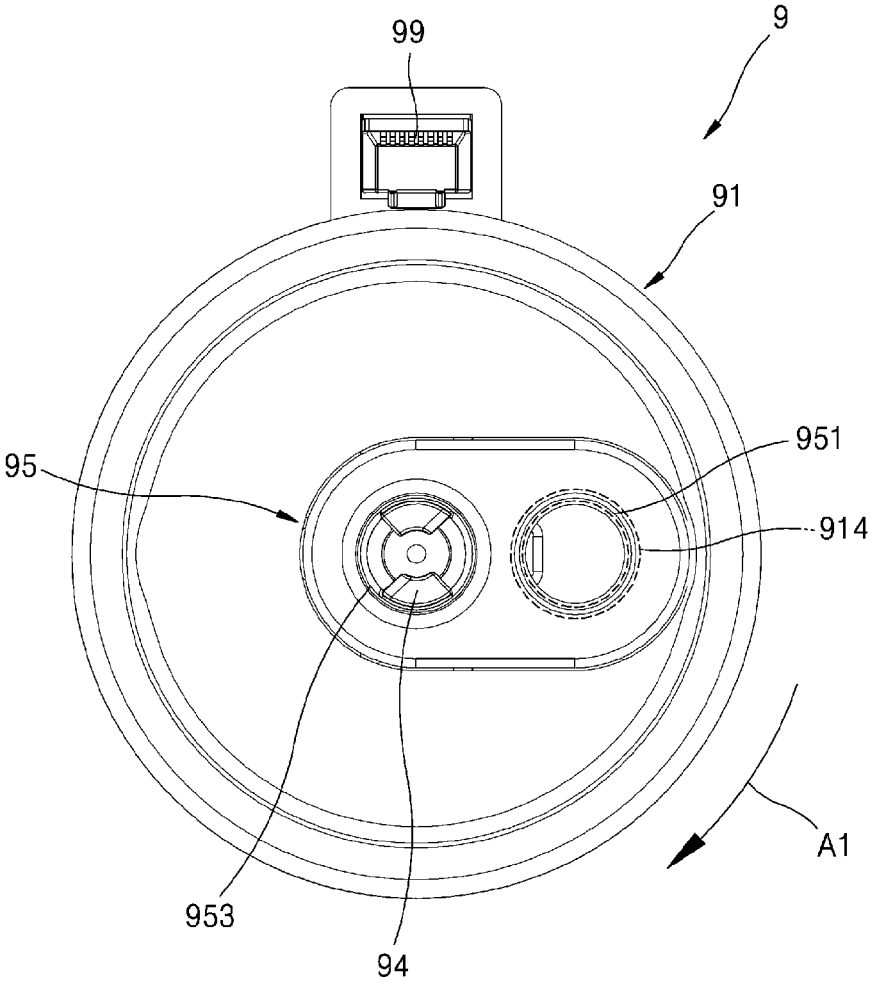
FIG. 9 illustrates a state in which a shutter is located at a second position of the toner refill cartridge of FIG. 4 according to an example.

FIGS. 8 and 9 respectively illustrate a state in which a shutter is located at a first position and at a second position of the toner refill cartridge of FIG. 4 according to various examples. An example of a process of filling toner in the toner accommodation portion 230 by using the toner refill cartridge 9 that is described above is described with reference to FIGS. 1 to 9.

Referring to FIGS. 8 and 9, when a remaining amount of toner in the toner accommodation portion 230 is less than or equal to a reference amount, a toner remaining amount sensor may generate a toner low signal. As an example, the image forming apparatus may output the toner low signal via a visible and/or audible output device.

A user mounts the toner refill cartridge 9 in the toner filling portion 10 via the communicating portion 8. The image forming apparatus detects the mounting of the toner refill cartridge 9 through communication with the communication portion 99. The image forming apparatus may determine, for example, whether the toner refill cartridge 9 is a normal (e.g., authorized) toner refill cartridge. When the mounting of the toner refill cartridge 9 is completed, the image forming apparatus performs a toner refill process.

As illustrated in FIG. 8, the shutter 95 is located at the first position at which the toner discharge hole 914 is closed because the opening portion 951 is misaligned with the toner discharge hole 914. In this state, toner is not discharged from the body 91.

The image forming apparatus drives a drive motor (not shown) in a forward direction. A rotational force of the drive motor in the forward direction is transmitted to the coupler 94 via the drive coupler, and thus the coupler 94 is rotated in the first direction A1. As illustrated in FIG. 6, when the coupler 94 is rotated in the first direction A1, the planet gear 120 moves along the guide portion 113 in the first direction A1 that is the rotation direction of the sun gear 941, so as to be engaged with the latch portion 114. As the planet gear 120 is unable to be further rotated, the link member 110 is rotated with the coupler 94 in the first direction A1, and the shutter 95 connected to the link member 110 is also rotated in the first direction A1. For example, when the shutter 95 is rotated by 90° in the first direction A1, as illustrated in FIG. 9, the shutter 95 reaches the second position at which the toner discharge hole 914 is opened because the opening portion 951 and the toner discharge hole 914 are aligned with each other. In that case, the image forming apparatus may stop the drive motor. In an example, the image forming apparatus may stop the drive motor when the shutter 95 reaches the second position by counting a forward directional drive time during which the drive motor is driven in the forward direction.

The agitation member 96 is connected to the coupler 94 through the drive shaft 97. Accordingly, when the coupler 94 is rotated in the first direction A1, the agitation member 96 is also rotated in the first direction A1. While the shutter 95 is driven to open the toner discharge hole 914, the toner inside the body 91 is agitated so that fluidity of the toner increases and thus the toner is ready to be more easily discharged.

As the toner discharge hole 914 is opened, toner inside the body 91 is discharged through the toner discharge hole 914 to the toner accommodation portion 230 via the toner filling portion 10.

To improve discharge of the toner, the toner inside the body 91 may be agitated by rotating the agitation member 96. To rotate the agitation member 96 while maintaining the shutter 95 at the second position, the image forming apparatus drives the drive motor to rotate in the reverse direction. In that case, the coupler 94 is rotated in the second direction A2. When the coupler 94 rotates in the second direction A2, the planet gear 120 moves along the guide portion 113 in the second direction A2 that is the rotation direction of the sun gear 941, so as to be separated from the latch portion 114, as illustrated in FIG. 7. The link member 110 is not rotated, and the shutter 95 is not rotated either and thus the shutter 95 is maintained at the second position. As the agitation member 96 is connected to the coupler 94 through the drive shaft 97, when the coupler 94 is rotated in the second direction A2, the agitation member 96 is also rotated in the second direction A2. As the toner inside the body 91 is agitated and the fluidity of toner is increased, the toner may be more easily discharged through the toner discharge hole 914.

When the toner filling is completed, before the toner refill cartridge 9 is separated from the toner filling portion 10, the shutter 95 may be switched from the second position to the first position. Accordingly, in the process of separating the toner refill cartridge 9, toner leakage to the outside may be reduced or prevented. In an example, as the shutter 95 is further rotated in the first direction A1, the shutter 95 may be moved between the first position and the second position. The image forming apparatus drives the drive motor to rotate in the forward direction. The rotational force of the drive motor in the forward direction is transmitted to the coupler 94 via the drive coupler, and the coupler 94 is rotated in the first direction A1. Referring to FIG. 6, as described above, the link member 110 is rotated with the coupler 94 in the first direction A1, and the shutter 95 connected to the link member 110 is rotated in the first direction A1. For example, when the shutter 95 is rotated by 270° in the first direction A1, as illustrated in FIG. 8 the shutter 95 reaches the first position at which the toner discharge hole 914 is closed because the opening portion 951 and the toner discharge hole 914 are misaligned with each other. The image forming apparatus may stop the drive motor when the shutter 95 reaches the first position, by counting, for example, the forward directional drive time during which the drive motor is driven in the forward direction.

The user may separate the toner refill cartridge 9 from the toner filling portion 10 while the shutter 95 is located at the first position. Accordingly, the toner filling is completed.

Because the switching of the shutter 95 between the first and second positions is performed by the image forming apparatus while the toner refill cartridge 9 is mounted in the toner filling portion 10, contamination of the image forming apparatus due to toner leakage in the toner filling process may be reduced. Furthermore, as the toner filling speed is not dependent on the manipulation of a user, an injection of toner by the user that is too rapid may be prevented. Thus, the toner supply speed may be more consistent, and the inflow of air may be reduced so that spray of the toner due to an increase of pressure in the developing cartridge 2 may be prevented. Furthermore, as the agitation member 96 is rotated to agitate the toner, shaking the toner refill cartridge 9 to address hardened toner before the toner filling is not necessary. Accordingly, user convenience may be improved.

Figure 10:
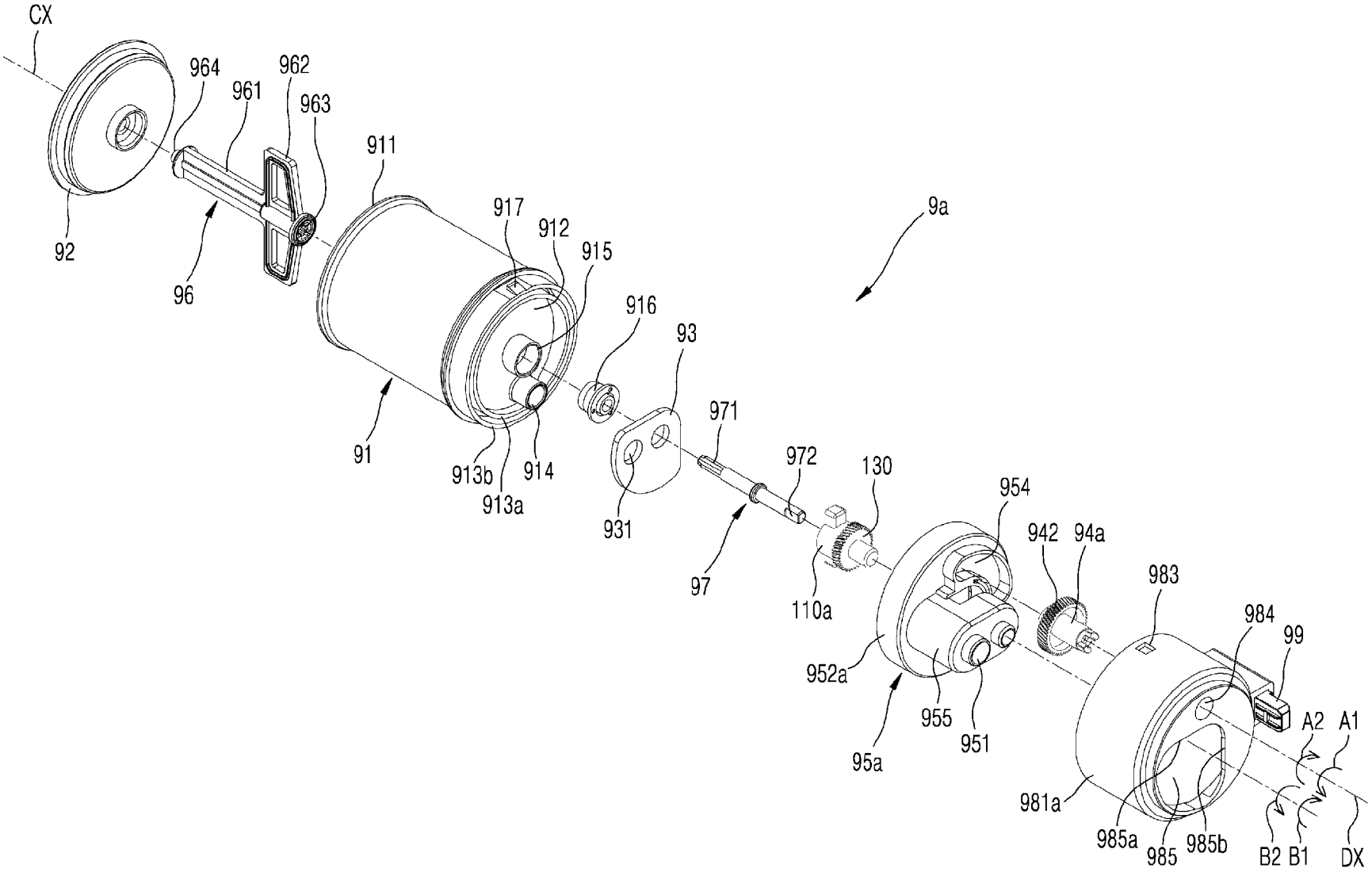
FIG. 10 is an exploded perspective view of a toner refill cartridge according to an example.
Figure 11:
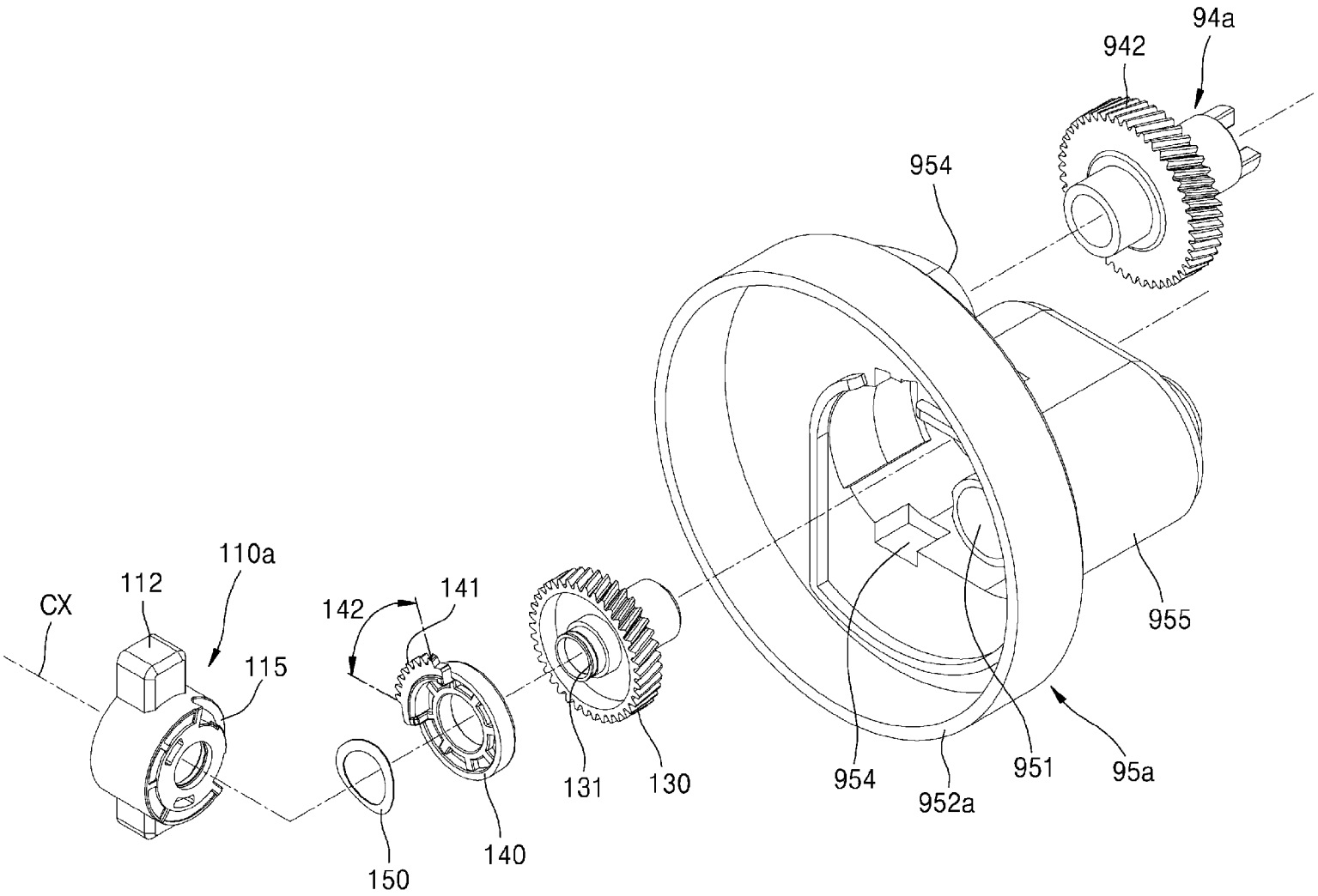
FIG. 11 is an exploded perspective view of a connection member according to an example.
Figure 12:
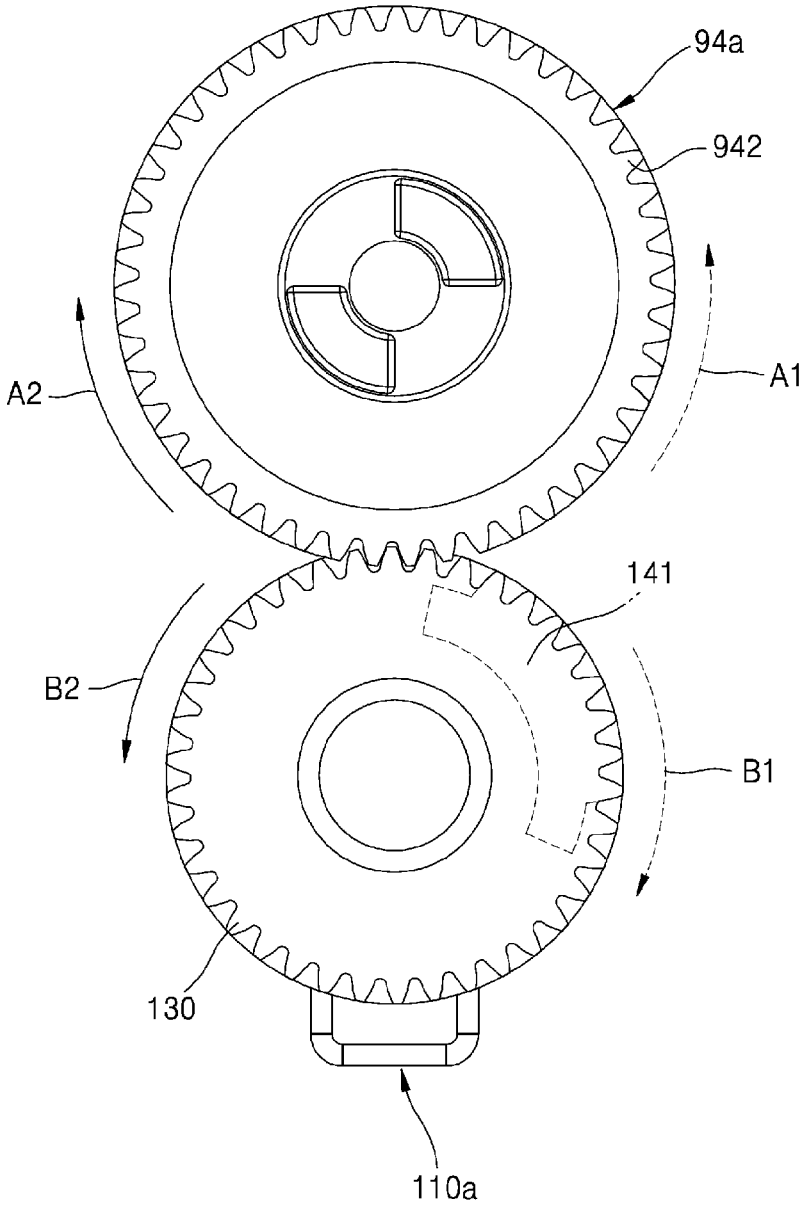
FIG. 12 illustrates an operation of the connection member of FIG. 11, showing a state in which a shutter is located at a first position according to an example.
Figure 13:
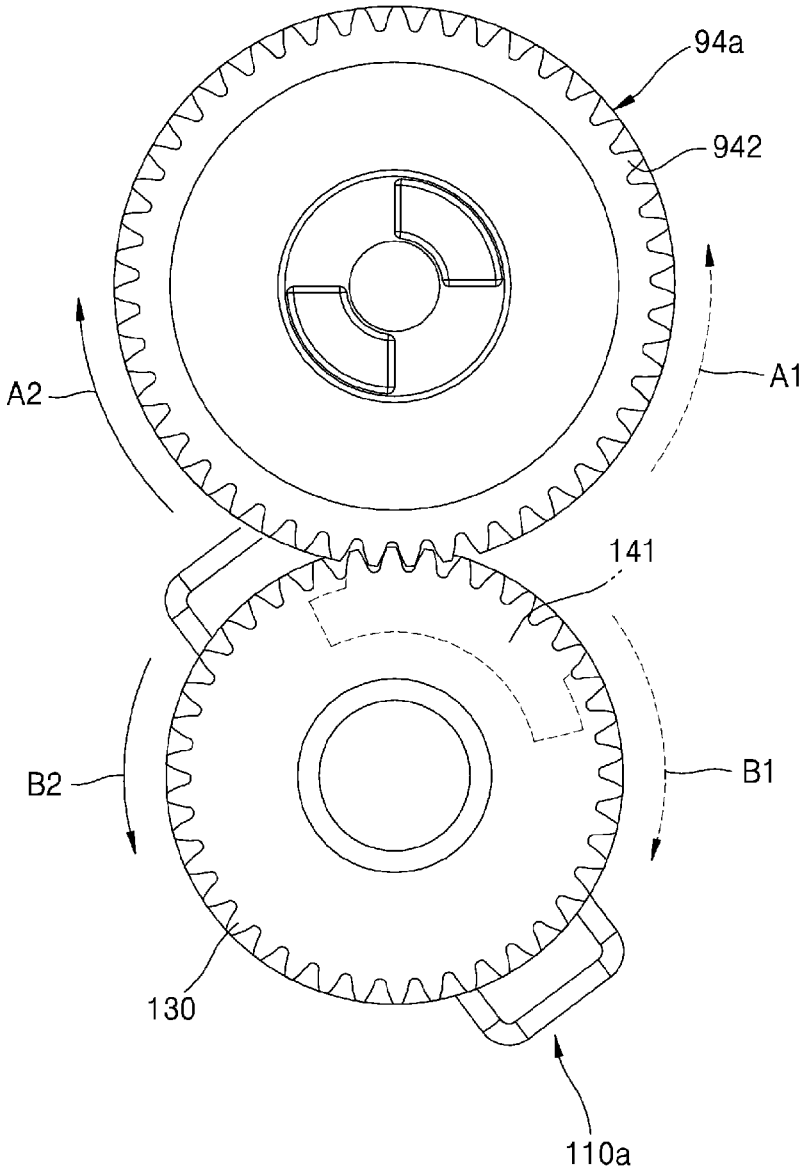
FIG. 13 illustrates an operation of the connection member of FIG. 11, showing a state in which a partial gear portion is engaged with a drive gear portion according to an example.
Figure 14:
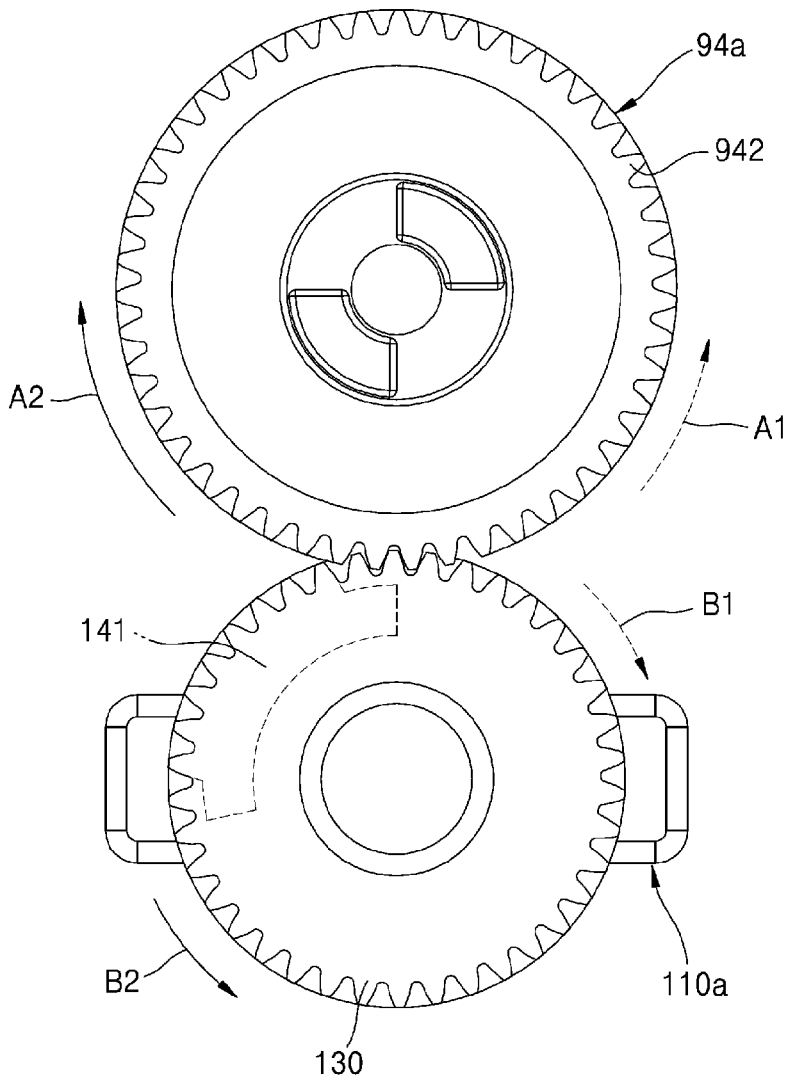
FIG. 14 illustrates an operation of the connection member of FIG. 11, showing a state in which a shutter is located at a second position according to an example.
Figure 15:
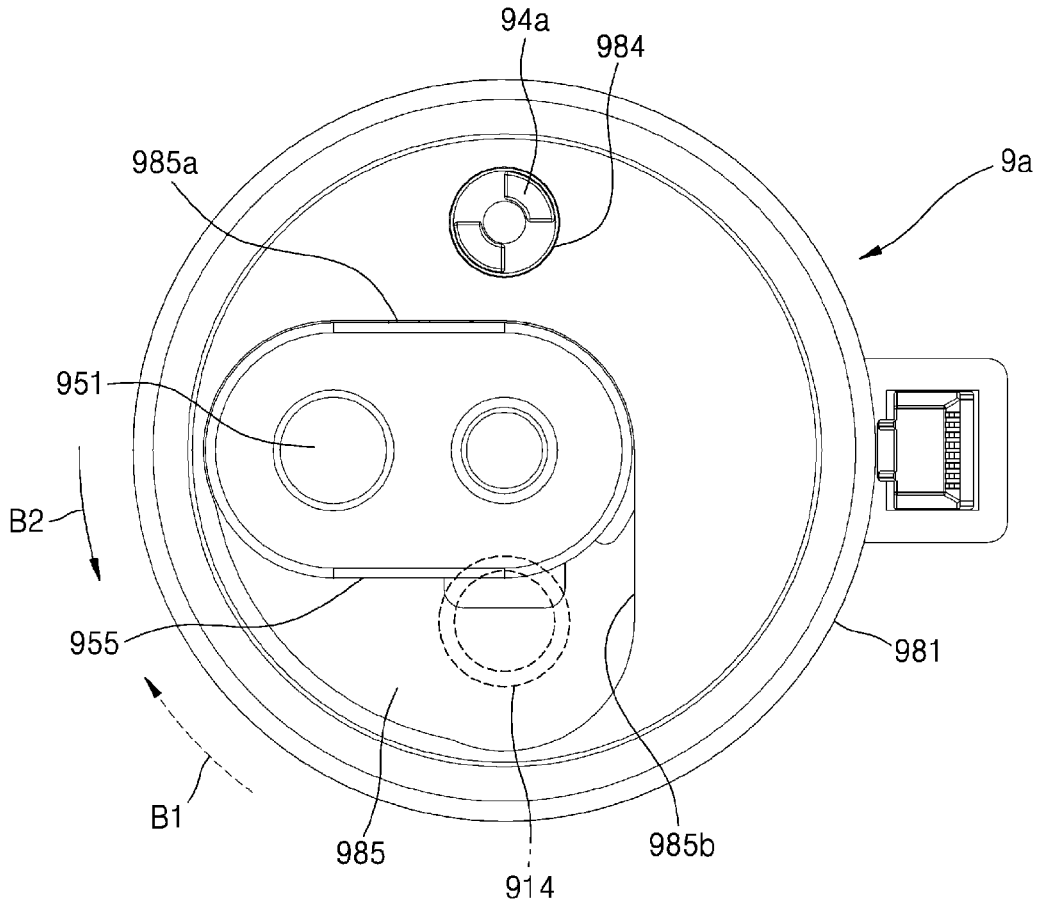
FIG. 15 illustrates a state in which a shutter is located at a first position, of the toner refill cartridge of FIG. 10 according to an example.
Figure 16:
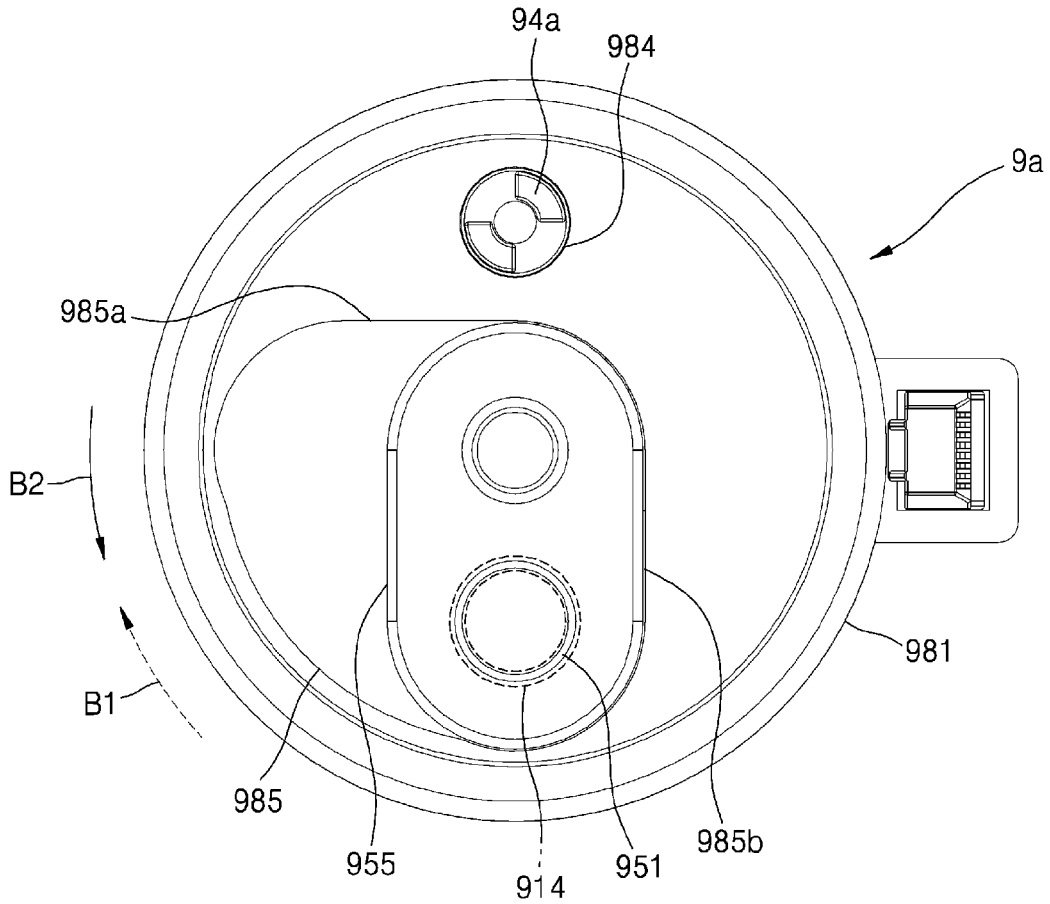
FIG. 16 illustrates a state in which a shutter is located at a second position, of the toner refill cartridge of FIG. 10 according to an example.

FIG. 10 is an exploded perspective view of a toner refill cartridge according to an example. FIG. 11 is an exploded perspective view of a connection member according to an example. FIGS. 12, 13, and 14 illustrate operations of the connection member of FIG. 11, in which FIG. 12 illustrates that a shutter is located at a first position, FIG. 13 illustrates that a partial gear portion is engaged with a drive gear portion, and FIG. 14 illustrates that a shutter is located at a second position according to various examples. FIGS. 15 and 16 respectively illustrate a state in which a shutter is located at a first position and at a second position of the toner refill cartridge of FIG. 10 according to various examples. In the following description, differences between a toner refill cartridge 9*a* and the toner refill cartridge 9 are mainly described. Elements that perform the same functions as those of the toner refill cartridge 9 are denoted by the same reference numerals, and redundant descriptions thereof are omitted.

Referring to FIGS. 10 and 11, a rotation axis of a shutter 95*a* and a rotation axis DX of a coupler 94*a* are misaligned with each other. In other words, the rotation axis DX of the coupler 94*a* is parallel to the rotation axis of the shutter 95*a* and located to be displaced from the rotation axis of the shutter 95*a*. The shutter 95*a* and the agitation member 96 are rotated around the same rotation axis. The shutter 95*a* and the agitation member 96 are rotated around the center axis CX of the body 91, and the rotation axis DX of the coupler 94*a* is located to be displaced from the center axis CX in the radial direction. A pair of support ribs 913*a* and 913*b*, each having a cylindrical shape with the origin of the center axis CX and having a diameter different from each other, is provided at the other end portion 912 of the body 91. The shutter 95*a* is provided with a cylindrical protruding portion 952*a* that is inserted between the support ribs 913*a* and 913*b*. Accordingly, the shutter 95*a* may be supported by the body 91 to be rotated around the center axis CX between the first position and the second position. The coupler 94*a* is rotatably supported by a support portion 954 provided in the shutter 95*a*. The support portion 954 is located to be displaced from the center axis CX in the radial direction. To allow the shutter 95*a* to rotate between the first and second positions, the support portion 954 may have an arc shape with respect to the center axis CX. The coupler 94*a* is exposed to the outside through a power connection opening 984 provided in a cover 981*a*.

The shutter 95*a* rotates in the rotation direction of the coupler 94*a* by switching between the first position and the second position. A stopper for preventing the shutter 95*a* from further rotating beyond the first position and the second position is provided on the cover 981*a*. For example, the cover 981*a* includes a through-hole 985 having a fan shape. The shutter 95*a* is provided with an insertion portion 955 that is inserted into the through-hole 985. When the shutter 95*a* is located at the first position, the insertion portion 955 comes in contact with an edge of the through-hole 985 in the first direction A1 so as to prevent the shutter 95*a* from further rotating beyond the first position. When the shutter 95*a* is located at the second position, the insertion portion 955 comes in contact with an edge of the through-hole 985 in the second direction A2, so as to prevent the shutter 95*a* from further rotating beyond the second position.

An example of a connection member connecting the coupler 94*a* to the shutter 95*a* is described. Referring to FIG. 11, the connection member may include a driven gear 130, a rotation member 140, a friction providing member 150, a link member 110*a*, and a drive gear portion 942.

The driven gear 130 is rotated by being connected to the coupler 94*a*. The rotation member 140 is supported by the driven gear 130 so as to be rotated coaxially with the driven gear 130. For example, a shaft support portion 131 is provided on the driven gear 130, and the rotation member 140 is rotatably supported by the shaft support portion 131. The rotation member 140 is provided with a partial gear portion 141 corresponding to a rotation angle between the first position and the second position of the shutter 95*a*, for example, about 90°. In other words, a formation angle 142 of the partial gear portion 141 may be less than, for example, about 90° or slightly less.

The link member 110*a* is connected to the shutter 95*a* so as to rotate the shutter 95*a*. For example, the link member 110*a* is provided with the protruding portion 112, and the shutter 95*a* may be provided with the concave portion 954 having a complementary shape with the protruding portion 112. The protruding portion 112 is inserted into the concave portion 954. According to the above configuration, when the link member 110*a* is rotated, the shutter 95*a* may be rotated.

The link member 110*a* is connected to the rotation member 140 in an axial direction and rotated with the rotation member 140. For example, the partial gear portion 141 may have a shape protruding from the rotation member 140 toward the link member 110*a*. An accommodation portion 115 that is concave to accommodate the partial gear portion 141 may be provided in the link member 110*a*. Accordingly, when the rotation member 140 is rotated, the link member 110*a* may be rotated.

The coupler 94*a* is provided with the drive gear portion 942 that is engaged with the driven gear 130 and the partial gear portion 141. The friction providing member 150 provides a rotational friction force to the rotation member 140 and the driven gear 130. For example, the friction providing member 150 may be implemented by a disc spring provided between the link member 110*a* and the rotation member 140. The friction providing member 150 elastically presses the rotation member 140 against the driven gear 130. Accordingly, even when the drive gear portion 942 and the partial gear portion 141 are not engaged with each other, as the driven gear 130 is rotated, the rotation member 140 is ready to be rotated. When the rotation member 140 is unable to be rotated further, a slip occurs between the rotation member 140 and the driven gear 130, and the driven gear 130 may be rotated even when the rotation member 140 is stopped.

Referring to FIGS. 10 and 11, the other end portion 972 of the drive shaft 97 may be connected to the driven gear 130 by passing through the link member 110*a*, the friction providing member 150, and the rotation member 140. When the driven gear 130 is rotated, the agitation member 96 is rotated.

Referring to FIG. 12, the driven gear 130 is engaged with the drive gear portion 942, and the partial gear portion 141 is not engaged with the drive gear portion 942. This state corresponds to the first position of the shutter 95*a*, as illustrated in FIG. 15. As the opening portion 951 is located to be misaligned with the toner discharge hole 914, the toner discharge hole 914 is in a closed state. In this state, when the coupler 94*a* is rotated in the first direction A1, a rotational force in a direction B1 that is opposite to the first direction A1 acts on the driven gear 130. The rotational force in the direction B1 acts on the shutter 95*a* by the frictional force provided by the friction providing member 150 via the rotation member 140 and the link member 110*a*. As illustrated in FIG. 15, as the insertion portion 955 of the shutter 95*a* is inserted into the through-hole 985 of the cover 981, and the insertion portion 955 is in contact with a first stopper 985*a*, the shutter 95*a* is not rotated. Accordingly, the rotation member 140 is not rotated. A slip occurs between the driven gear 130 and the rotation member 140, and only the driven gear 130 is rotated in the direction B1. The agitation member 96 is connected to the driven gear 130 and rotated in the direction B1.

When the coupler 94*a* is rotated in the second direction A2 in the state as illustrated in FIG. 12, a rotational force in a direction B2 that is opposite to the second direction A2 acts on the driven gear 130. The rotational force in the direction B2 acts on the shutter 95*a* by the frictional force provided by the friction providing member 150 via the rotation member 140 and the link member 110*a*. In the state as illustrated in FIG. 15, the rotation of the shutter 95*a* in the direction B2 is allowed. The driven gear 130, the rotation member 140, the link member 110*a*, and the shutter 95*a* are rotated in the direction B2. As illustrated in FIG. 13, when the partial gear portion 141 is engaged with the drive gear portion 942, the rotation member 140, the link member 110*a*, and the shutter 95*a* are rotated by the drive gear portion 942 in the direction B2. Before the shutter 95*a* reaches the second position illustrated in FIG. 16, the engagement between the partial gear portion 141 and the drive gear portion 942 may be terminated. Thereafter, by the frictional force provided by the friction providing member 150, the rotation member 140, the link member 110*a*, and the shutter 95*a* may continue to rotate in the direction B2. As illustrated in FIG. 16, as the shutter 95*a* reaches the second position, the toner discharge hole 914 is opened as the opening portion 951 and the toner discharge hole 914 are aligned with each other. The insertion portion 955 of the shutter 95*a* contacts a second stopper 985*b*, and the shutter 95*a* is no longer rotated and is maintained at the second position. A slip occurs between the driven gear 130 and the rotation member 140, and as illustrated in FIG. 14, only the driven gear 130 is rotated in the direction B2. As the agitation member 96 is connected to the driven gear 130, the agitation member 96 is rotated in the direction B2.

In order to switch the shutter 95*a* back to the first position, in a state illustrated in FIGS. 14 and 16, the coupler 94*a* is rotated in the first direction A1. The rotational force in the direction B1 acts on the driven gear 130. By the frictional force provided by the friction providing member 150, the rotational force in the direction B1 acts on the shutter 95*a* via the rotation member 140 and the link member 110*a*. In the state illustrated in FIG. 16, the rotation of the shutter 95*a* in the direction B1 is allowed. The driven gear 130, the rotation member 140, the link member 110*a*, and the shutter 95*a* are rotated in the direction B1. As illustrated in FIG. 13, when the partial gear portion 141 is engaged with the drive gear portion 942, the rotation member 140, the link member 110*a*, and the shutter 95*a* are rotated by the drive gear portion 942 in the direction B1. Before the shutter 95*a* reaches the first position illustrated in FIG. 15, the engagement between the partial gear portion 141 and the drive gear portion 942 may be terminated. Thereafter, by the frictional force provided by the friction providing member 150, the rotation member 140, the link member 110*a*, and the shutter 95*a* may continue to rotate in the direction B1. As illustrated in FIG. 15, when the shutter 95*a* reaches the first position at which the toner discharge hole 914 is closed, the insertion portion 955 of the shutter 95*a* comes in contact with the first stopper 985*a*, and the shutter 95*a* is no longer rotated and maintained at the first position. A slip occurs between the driven gear 130 and the rotation member 140, and as illustrated in FIG. 12, only the driven gear 130 is rotated in the direction B1. As the agitation member 96 is connected to the driven gear 130, the agitation member 96 is rotated in the direction B1.

An example of a process of filling toner in the toner accommodation portion 230 by using the toner refill cartridge 9*a* that is described above is described with reference to FIGS. 10 to 16.

When a remaining amount of toner in the toner accommodation portion 230 is less than or equal to a reference remaining amount, the toner remaining amount sensor generates a toner low signal. The image forming apparatus may output the toner low signal via the visible and/or audible output device.

A user mounts the toner refill cartridge 9*a* in the toner filling portion 10 via the communicating portion 8. The image forming apparatus detects the mounting of the toner refill cartridge 9*a* through communication with the communication portion 99. The image forming apparatus may determine, for example, whether the toner refill cartridge 9*a* is a normal toner refill cartridge. When the mounting of the toner refill cartridge 9*a* is completed, the image forming apparatus performs a toner refill process.

As illustrated in FIG. 15, the shutter 95 is located at the first position at which the toner discharge hole 914 is closed as the opening portion 951 is misaligned with the toner discharge hole 914. In this state, the toner is not discharged from the body 91.

The image forming apparatus drives the drive motor (not shown) to rotate the coupler 94 in the second direction A2. The driven gear 130 is rotated in the direction B2, and as described above, the shutter 95*a* reaches the second position illustrated in FIG. 16 and is maintained at the second position at which the toner discharge hole 914 is opened by the second stopper 985*b*. A slip occurs between the driven gear 130 and the rotation member 140, and as illustrated in FIG. 14, only the driven gear 130 is rotated in the direction B2. The agitation member 96 is connected to the driven gear 130 via the drive shaft 97. Accordingly, when the coupler 94 is rotated in the second direction A2, the agitation member 96 is also rotated in the direction B2. While the shutter 95*a* is driven to open the toner discharge hole 914, the toner inside the body 91 is agitated so as to increase the fluidity of toner, and thus the toner may be ready to be more easily discharged.

As the toner discharge hole 914 is opened, toner inside the body 91 may be discharged through the toner discharge hole 914 to the toner accommodation portion 230 via the toner filling portion 10. For smoother discharge of the toner, the coupler 94*a* may be continuously rotated in the second direction A2 so as to drive the agitation member 96.

When the toner filling is completed, the shutter 95*a* may be switched from the second position to the first position. According to an example, the shutter 95*a* rotates to switch between the first position and the second position. The image forming apparatus drives the drive motor to rotate the coupler 94*a* in the first direction A1. As described above, the shutter 95*a* is rotated in the direction B1 to reach the first position illustrated in FIG. 15 and maintained by the first stopper 985*a* at the first position at which the toner discharge hole 914 is closed. The drive gear portion 942, the driven gear 130, and the partial gear portion 141 are returned to the state illustrated in FIG. 12. The image forming apparatus stops the drive motor.

The user separates the toner refill cartridge 9*a* from the toner filling portion 10 in a state in which the shutter 95*a* is located at the first position. Accordingly, the toner filling is completed.

It should be understood that examples described herein should be considered in a descriptive sense only and not for purposes of limitation. Descriptions of features or aspects within each example should typically be considered as available for other similar features or aspects in other examples. While one or more examples have been described with reference to the figures, it will be understood by those of ordinary skill in the art that various changes in form and details may be made therein without departing from the spirit and scope as defined by the following claims.

What is claimed is:

1. A toner refill cartridge comprising:

a body to accommodate toner and having a toner discharge hole;

a shutter being rotatable between a first position at which the toner discharge hole is closed and a second position at which the toner discharge hole is opened;

a coupler to rotate by receiving an external rotational force;

an agitation member to rotate and agitate the toner by receiving a rotational force of the coupler; and a connection member to selectively transmit the rotational force of the coupler to the shutter, the connection member to:

in a first state, disengage the rotational force of the coupler from the shutter while supplying the rotational force of the coupler to the agitation member to rotate the agitation member, and in a second state, supply the rotational force of the coupler to the shutter and the agitation member to rotate the shutter and the agitation member.

2. The toner refill cartridge of claim 1, wherein the shutter, the coupler, and the agitation member are to rotate around a same rotation axis.

3. The toner refill cartridge of claim 2, wherein in the second state the connection member is to transmit the rotational force of the coupler in a first direction to the shutter, and wherein the shutter is to rotate in the first direction to be moved between the first position and the second position.

4. The toner refill cartridge of claim 3, wherein the connection member comprises:

a link member connected to the shutter and having a latch portion and a guide portion comprising a slot;

a sun gear provided in the coupler; and a planet gear provided in the guide portion, the planet gear to be rotated by engaging with the sun gear, wherein the connection member in the second state comprises the planet gear in engagement with the latch portion to allow the link member to rotate with the coupler when the coupler is rotated in the first direction, and wherein the connection member in the first state comprises the planet gear separated from the latch portion to prevent the link member from rotating when the coupler is rotated in a second direction that is opposite to the first direction.

5. The toner refill cartridge of claim 1, wherein a rotation axis of the coupler is parallel to a rotation axis of the shutter and displaced from the rotation axis of the shutter, and wherein the shutter and the agitation member are to rotate around a same rotation axis.

6. The toner refill cartridge of claim 5, wherein the shutter is to rotate to switch between the first position and the second position along a rotation direction of the coupler.

7. The toner refill cartridge of claim 6, further comprising a stopper to prevent the shutter from rotating beyond the first position and the second position.

8. The toner refill cartridge of claim 6, wherein the connection member comprises:

a driven gear;

a rotation member supported by the driven gear to coaxially rotate with the driven gear, the rotation member including a partial gear portion corresponding to a rotation angle between the first position and the second position of the shutter;

a friction providing member to provide a rotational frictional force to the rotation member and the driven gear;

a link member connected to the shutter to rotate with the rotation member by being connected to the rotation member in an axial direction; and a drive gear portion provided in the coupler to engage with the driven gear and the partial gear portion.

9. The toner refill cartridge of claim 8, wherein the agitation member is connected to the driven gear.

10. The toner refill cartridge of claim 8, wherein the connection member in the second state comprises the coupler engaged with the rotation member, and wherein the connection member in the first state comprises the coupler disengaged from the rotation member.

11. A toner refill cartridge comprising:

a body to accommodate toner and having a toner discharge hole;

a shutter being rotatable between a first position at which the toner discharge hole is closed and a second position at which the toner discharge hole is opened;

a coupler to rotate in a first direction and a second direction by receiving an external rotational force;

a connection member to selectively transmit a rotational force of the coupler to the shutter; and an agitation member provided in the body and connected to the coupler, the agitation member to agitate the toner by rotating in the first direction and the second direction, wherein the connection member is to transmit the rotational force of the coupler in the first direction to the shutter, wherein the shutter is to rotate in the first direction to be sequentially switched from the first position to the second position, and wherein the connection member comprises:

a link member connected to the shutter and having a latch portion and a guide portion comprising a slot;

a sun gear provided in the coupler; and a planet gear provided in the guide portion, the planet gear to be rotated by engaging with the sun gear, the planet gear to engage with the latch portion to allow the link member to rotate with the coupler when the coupler is rotated in the first direction and to separate from the latch portion to prevent the link member from rotating when the coupler is rotated in the second direction that is opposite to the first direction.

12. The toner refill cartridge of claim 11, wherein the shutter is to rotate to switch between the first position and the second position according to a rotation direction of the coupler, and wherein the toner refill cartridge comprises a stopper to prevent the shutter from rotating beyond the first position and the second position.

13. A toner refill cartridge comprising:

a body to accommodate toner and having a toner discharge hole;

a shutter being rotatable between a first position at which the toner discharge hole is closed and a second position at which the toner discharge hole is opened;

a coupler to rotate in a first direction and a second direction by receiving an external rotational force; and a connection member to selectively transmit a rotational force of the coupler to the shutter, wherein the connection member comprises:

a driven gear;

a rotation member supported by the driven gear to coaxially rotate with the driven gear, the rotation member including a partial gear portion corresponding to a rotation angle between the first position and the second position of the shutter;

a friction providing member to provide a rotational frictional force to the rotation member and the driven gear;

a link member connected to the shutter to engage with the rotation member to be rotated with the rotation member; and a drive gear portion provided in the coupler to engage with the driven gear and the partial gear portion.

14. The toner refill cartridge of claim 13, further comprising an agitation member provided in the body to agitate the toner by being rotated in the first direction and in the second direction, wherein the agitation member is connected to the driven gear.

15. The toner refill cartridge of claim 13, wherein the shutter is to rotate to switch between the first position and the second position according to a rotation direction of the coupler, and wherein the toner refill cartridge comprises a stopper to prevent the shutter from rotating beyond the first position and the second position.

* * * * *